United States Patent [19]

Childs et al.

[11] Patent Number: 4,625,970

[45] Date of Patent: Dec. 2, 1986

[54] POLITICAL GAME

[76] Inventors: Charles F. Childs; Linda M. O. Childs, both of 2936 Melbourne Ave., Dayton, Ohio 45417

[21] Appl. No.: 740,627

[22] Filed: Jun. 3, 1985

[51] Int. Cl.[4] ..... A63F 3/00

[52] U.S. Cl. ..... 273/257

[58] Field of Search ..... 273/257, 279, 244

[56] References Cited

U.S. PATENT DOCUMENTS

| | | | |
|---|---|---|---|
| 2,209,117 | 7/1940 | Garrett | 273/257 |
| 3,907,299 | 9/1975 | Kristen | 273/257 |
| 4,000,897 | 1/1977 | York | 273/244 X |
| 4,012,045 | 3/1977 | Vail | 273/257 |
| 4,216,967 | 8/1980 | Marse | 273/257 |

*Primary Examiner*—Paul E. Shapiro

*Attorney, Agent, or Firm*—Joseph Patrick Burke

[57] ABSTRACT

A political game is disclosed having a square or rectangular game board containing a plurality of spaces which are unfavorable, favorable or neutral; a set of three different playing pieces of the same color for each player; a set of drawing cards of one color which either assist or hinder the players' pursuit of higher political office ranging from candidate through governor and senator and culminating in the presidency; a set of hindering drawing cards of a contrasting color; a set of debate cards challenging the players' knowledge of American political history; paper play money; a pair of dice; a plurality of vote tokens, worth different numbers of votes and a set of rules and regulations governing play.

5 Claims, 16 Drawing Figures

FIG-7A

20

| | | | |
|---|---|---|---|
| WHAT IS THE MINIMUM AGE QUALIFICATION OF A U.S. PRESIDENT?<br>ANSWER: 35 YEARS OLD. | WHAT MAN LOST THE 1984 ELECTION BID FOR U.S. PRESIDENT?<br>ANSWER: WALTER MONDALE. | WHAT DEPARTMENT ENFORCES OR EXECUTES THE LAWS OR STATUTES THAT THE LEGISLATURE HAS ENACTED?<br>ANSWER: THE EXECUTIVE DEPARTMENT. | THE CONSTITUTION ESTABLISHED THE _____ _____ OF THE UNITED STATES AS THE HIGHEST JUDICIAL POWER?<br>ANSWER: SUPREME COURT. |
| WHO BECAME THE YOUNGEST MAN TO TAKE THE OATH OF OFFICE AS PRESIDENT?<br>ANSWER: THEODORE ROOSEVELT. | WHO WAS THE FIRST MAJOR BLACK PRESIDENTIAL CANDIDATE?<br>ANSWER: JESSE JACKSON. | THE VICE PRESIDENT HAS NO EXECUTIVE AUTHORITY. TRUE OR FALSE?<br>ANSWER: TRUE. | WHO WAS THE YOUNGEST MAN TO BE ELECTED U.S. PRESIDENT?<br>ANSWER: JOHN F. KENNEDY. |
| HOW OFTEN IS A U.S. PRESIDENT ELECTED?<br>ANSWER: EVERY FOUR YEARS. | A NEW U.S. PRESIDENT WINS THE ELECTION, BY WINNING AS LITTLE AS 270 ELECTORAL VOTES. TRUE OR FALSE?<br>ANSWER: TRUE. | WHAT IS THE MINIMUM AGE QUALIFICATION OF A U.S. SENATOR?<br>ANSWER: 30 YEARS OLD. | THE CABINET MEMBERS ARE CONFIRMED BY WHOM?<br>ANSWER: THE U.S. SENATE. |
| WHO IS THE PRESIDING OFFICER IN THE U.S. SENATE?<br>ANSWER: THE VICE PRESIDENT. | WHO HAS THE SOLE POWER OF STARTING THE PROCEDURE OF IMPEACHING GOVERNMENT OFFICIALS FOR MISCONDUCT?<br>ANSWER: THE U.S. HOUSE OF REPRESENTATIVES. | A U.S. REPRESENTATIVE MUST BE A UNITED STATES CITIZEN FOR AT LEAST 9 YEARS. TRUE OR FALSE?<br>ANSWER: FALSE. | THE CONGRESS OF THE UNITED STATES IS MADE UP OF WHAT TWO COMPONENT POWERS?<br>ANSWER: U.S. SENATE AND U.S. HOUSE OF REPRESENTATIVES. |

FIG-7B

20

WHAT IS THE MINIMUM AGE QUALIFICATION OF A U.S. REPRESENTATIVE?

ANSWER: 25 YEARS OLD.

THE PRESIDING OFFICER IN THE U.S. HOUSE OF REPRESENTATIVES IS THE SPEAKER.
TRUE OR FALSE ?

ANSWER: TRUE.

EACH STATE HAS HOW MANY U.S. SENATORS ?

ANSWER: TWO.

HOW LONG IS THE ELECTED TERM OF OFFICE OF EACH U.S. CONGRESSMAN?

ANSWER: TWO YEARS.

THERE ARE THREE DEPARTMENTS OF THE U.S. GOVERNMENT; NAME TWO.

ANSWER:
1-LEGISLATIVE DEPARTMENT.
2-EXECUTIVE DEPARTMENT.
3-JUDICIAL DEPARTMENT.

WHAT DEPARTMENT IN THE U.S. GOVERNMENT MAKES THE LAWS?

ANSWER: THE LEGISLATIVE DEPT.

WHAT IS THE LOWER US HOUSE OF CONGRESS CALLED ?

ANSWER: THE U.S. HOUSE OF REPRESENTATIVES.

THERE ARE SEVEN MAIN SECTIONS OF THE CONSTITUTION. WHAT ARE THESE SECTIONS CALLED ?

ANSWER: ARTICLES.

TO WHOM DOES THE CONSTITUTION GIVE THE EXECUTIVE POWER OF THE GOVERNMENT ?

ANSWER: THE U.S. PRESIDENT.

TO BE ELIGIBLE FOR ELECTION TO THE U.S. SENATE, A PERSON MUST BE A U.S. CITIZEN FOR AT LEAST HOW MANY YEARS ?

ANSWER: 9 YEARS.

WHAT OFFICER IN THE U.S. HOUSE OF REPRESENTATIVES RECEIVES THE HIGHEST PAY ?

ANSWER: THE SPEAKER.

THE U.S. SENATE HAS HOW MANY POWERS THAT ARE DENIED TO THE U.S. HOUSE OF REPRESENTATIVES

ANSWER: THREE.

A U.S. SENATOR MUST LIVE IN THE STATE WHICH HE REPRESENTS.
TRUE OR FALSE ?

ANSWER: TRUE

A U.S. REPRESENTATIVE MUST BE A CITIZEN OF THE UNITED STATES FOR HOW MANY YEARS ?

ANSWER: 7 YEARS

A U.S. REPRESENTATIVE DOESN'T HAVE TO LIVE IN A STATE HE REPRESENTS.
TRUE OR FALSE

ANSWER: FALSE

WHAT IS THE NAME OF THE DISTRICT THAT SELECTS THEIR U.S. REPRESENTATIVE ?

ANSWER: THE U.S. CONGRESSIONAL DISTRICT.

FIG-7C

20

| | | | |
|---|---|---|---|
| HOW OFTEN IS A NATIONAL CENSUS DONE? ANSWER: EVERY TEN YEARS. | HOW OFTEN DOES U.S. CONGRESS MEET? ANSWER: EVERY YEAR. | THE U.S. PRESIDENT TAKES OFFICE IN WHAT MONTH? ANSWER: JANUARY. | WHO APPOINTS CABINET MEMBERS? ANSWER: THE U.S. PRESIDENT. |
| THE SUPREME COURT CONSISTS OF WHAT? ANSWER: CHIEF JUSTICE AND 8 ASSOCIATE JUSTICES. | WHEN THE U.S. PRESIDENT IS IMPEACHED, THE SPEAKER OF THE U.S. HOUSE OF REPRESENTATIVES TAKES OVER. TRUE OR FALSE? ANSWER: FALSE. | THE VICE PRESIDENT IS CHOSEN BY THE U.S. PRESIDENT AFTER HE TAKES OFFICE. TRUE OR FALSE? ANSWER: FALSE. | WHAT IS A COALITION OF VOTERS ADHERING TO COMMON PRINCIPLES AND SEEKING TO CONTROL THE U.S. GOVERNMENT? ANSWER: POLITICAL PARTY. |
| NAME ONE OF THE LAST TWO STATES ADMITTED TO THE UNITEDSTATES. ANSWER: ALASKA OR HAWAII. | NO NOMINATING METHODS WERE NECESSARY IN THE FIRST THREE U.S. PRESIDENTIAL ELECTIONS. TRUE OR FALSE? ANSWER: TRUE | THE U.S. CONGRESS ELECTED IN 1980 WAS THE NINETY-SEVENTH U.S. CONGRESS. TRUE OR FALSE? ANSWER: TRUE | RESPONSIBILITY FOR THE ADMINISTRATION AND ENFORCEMENT OF IMMIGRATION LAWS RESTS PRIMARILY WITH THE U.S. SECRETARY OF STATE AND THE ATTORNEY GENERAL. TRUE OR FALSE? ANSWER: TRUE |
| HOW MANY U.S. EXECUTIVE DEPARTMENTS WERE THERE IN 1979? ANSWER: THIRTEEN. | AFL AND CIO WERE JOINED TOGETHER IN 1955. TRUE OR FALSE? ANSWER: TRUE. | WHAT TWO MAJOR POLITICAL PARTIES ARE THERE IN THE UNITED STATES? ANSWER: U.S. DEMOCRATS AND U.S. REPUBLICANS. | WHAT U.S. PRESIDENT RESIGNED FROM OFFICE FOLLOWING THE WATERGATE AFFAIR? ANSWER: RICHARD NIXON. |

FIG-7D
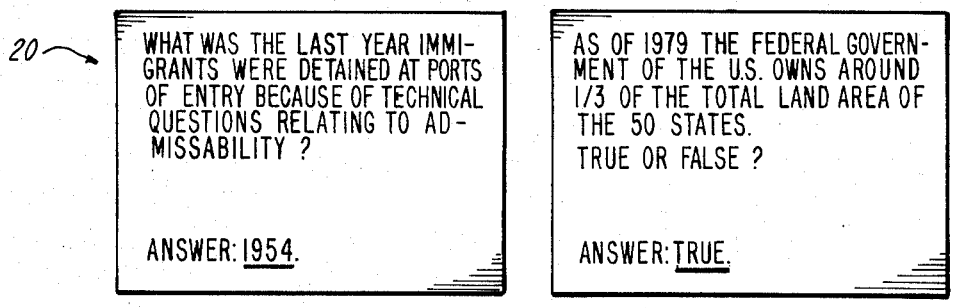
FIG-8
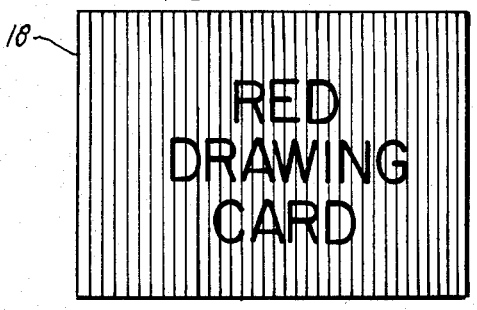
FIG-9
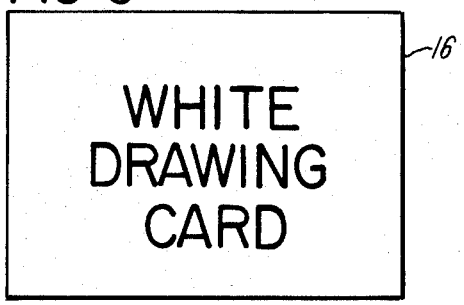
FIG-10
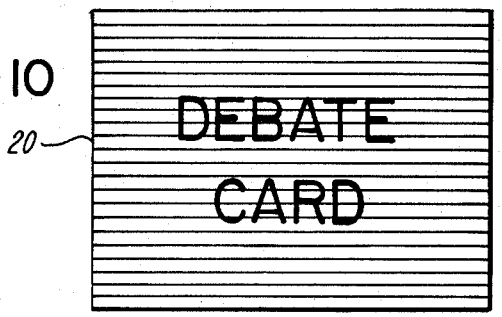
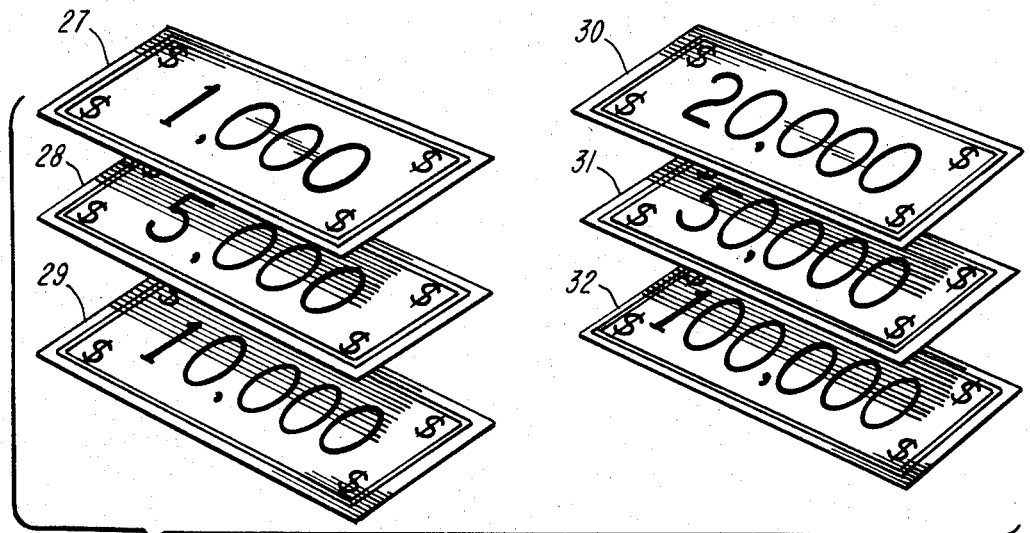
FIG-11

POLITICAL GAME

GENERAL DESCRIPTION OF THE INVENTION

The present invention is directed to a political game concerning the pursuit of high political offices in the United States of America which combines the elements of fun, risk, luck, skill and historical knowledge and perspective. This game comprises a square or rectangular game board which includes, along the outer periphery thereof, a plurality of divided spaces or sections, each of which has an unfavorable, favorable, or neutral situation or direction (order) for a player whose playing piece lands thereon; a set of different playing pieces for each player, including a potential plurality thereof up to a maximum of three for each player, each playing piece within the set for each player being of the same color, but having readily distinguishable facial expressions with two of the pieces in each set additionally having indicia or marking indicating the player status and political position; a plurality of drawing cards of a first color, e.g., white, each of which either furthers (assists) or hinders (retards) each respective player's pursuit of higher political office potentially culminating in the Presidency of the United States of America; a plurality of drawing cards of a contrasting color, e.g. red, each of which only hinders a player's pursuit of higher political office; a plurality of debate cards which challenge the debating players' knowledge of American political history including detailed and obscure (trivial) knowledge; paper play money of a plurality of different denominations and worth, e.g., six; a pair of dice of generally cubical shape and containing six substantially flat surfaces, each surface containing a different number of dots ranging from one to six; a plurality of vote tokens, having a plurality of different denominations and worth a different number of votes, e.g., four (4), and a set of rules and regulations governing play whereby to win, a player either progresses from candidate to governor to senator to president by sequentially acquiring a combination of money and votes for each office, or is the only player to remain financially solvent whereas all opposing players have gone bankrupt.

This game is played using a combination of the roll of the dice, the position of the player on the board, along with each player's respective response to the drawing cards of contrasting colors, the strategy of use of debate cards, all with respect to the combined accumulation of votes and money, or the avoidance of bankruptcy under circumstances wherein all opponents have been declared bankrupt and no individual player has a combination of the sufficient number of votes and money to become president.

Since the number of debates in which each player engages both as a debate challenger and challengee, is within the control of each respective player and opponents; the player having the superior knowledge and being able to answer the questions challenging one's knowledge of American political history and related details (political trivia) will have a distinct advantage in acquiring votes and progressing along the clockwise path of travel on the game board, thereby acquiring greater amounts of money and numbers of votes. Skill is required of each player in determining which opposing player(s) to challenge to debate and when to do so in relation to one's own position in acquiring the necessary combination of money and votes in the pursuit of higher political office. The penalties in loss of money and votes for losing a debate are significant, which places emphasis on acquiring and retaining knowledge of the American political system as quickly as possible. It is recognized and envisioned that this game may include a plurality of different sets of debate cards, each set containing questions of a given level of difficulty so that this game may be played at different age, schooling and educational development levels requiring different levels of knowledge and sophistication by the players. As players progress from one level to the next, and so on; this game will have achieved a higher level of its teaching function and increased the level of political knowledge of its players.

BACKGROUND OF THE INVENTION AND PRIOR ART

The board game of this invention is of the general type of board games in which a basically flat, square or rectangular board is utilized in conjunction with defined spaces along the outer periphery of the board with inner spaces for stacks of direction-giving situational chance cards which are picked up or retrieved by each respective player landing on such defined peripheral spaces. A pair of conventional dice is employed in conjunction with the playing pieces to enable each player to progress in a clockwise direction around the board in a continual way until one player is in the position of being the winner. However, that is where the similarity ends.

In accordance with the present invention, during play both tokens and paper money are employed and hopefully accumulated by the players until one player acquires the respective minimum combinations of votes and money to progress from political candidate to governor to U.S. Senator to U.S. President while sequentially acquiring the political status essential thereto. The board game of the present invention incorporates a necessity to acquire, as soon as each respective player can do so, at least a threshold knowledge of American political history and a detailed knowledge of certain qualifications and situations involved in attaining and seeking these high political offices in the United States of America. A key object of this invention is increasing the knowledge of each player in this respect. Hence the present invention has a definite teaching function above and beyond the play of the game itself.

Examples of prior patents directed to board games are discussed as follows:

Possibly the best known American board game is described in U.S. Pat. No. 2,026,082 issued to C. B. Darrow and entitled "MONOPOLY". This game has a substantially square, flat-surfaced board containing various streets, public utilities, favorable or unfavorable situations arranged in divided spaces positioned along the outer periphery of the board along with interiorally positioned spaces for packs of situation cards which may be favorable or unfavorable to the player directed to pick the respective situation card from the interior of the board. A plurality of playing pieces are utilized, along with a pair of conventional dice to acquire property and money with the game ending when either the remaining player(s) acknowledge(s) defeat and submits, or when one player has all of the money and property. In the play of the game, as property is acquired and another (non-owning) player lands on the property, various amounts of money (as indicated on title cards) must be paid to the owning player. The game of "MO- NOPOLY" has no basic teaching function with regard to any particular aspect of pursuit of high American political office leading to the Presidency.

French Pat. No. 2,363,346 (DEMANDE DE BREVET D'INVENTION NO. 76 26729) is disclosed as having a local or national government theme with each player representing a political party as denoted by a color. There are four colors disclosed, thus permitting four players to play the game. The board forms a circuit and has several cards relating to recounts of elections; irregularities throughout such an election; balloting conducted during such election and similar hazards. In playing this political game, each player throws three dice, two of these being conventional. The third die has three blank faces and three marked "incident". A card is taken from a constituency pack, which card contains the results relating to this. Votes are proportional according to the numbers thrown on the dice. An "incident" requires the player to take a card giving details to be followed by each respective player involved in such "incident". The player getting the maximum number of votes wins the seat and the maximum number of seats wins the game.

U.S. Pat. No. 398,233 to J. P. and J. W. Clarke is directed to a political game concerning the American political system which is played with cards especially designed for the purpose of teaching the player various aspects of the elective process to become a Mayor, U.S. Congressman, U.S. Governor, and President. This game is played with a board of rectangular shape; six sets consisting of 48 cards; 2 buttons or "wads"; and pegs. Two, four, or six persons can play this game. If four people play, there are two "sides" of two partners each, e.g. the Democrats vs. the Republicans. This board game is disclosed as having been designed for the purpose of "the game of politics" or "the race for the Presidency." The main objective of the game is stated in Rule 9 as "Having entered the candidate, the aim is to push him along up the ladder till he is elected—that is, until he reaches the chair at the top of the ladder". Included in the Clarke game and positioned on the game board is a list of 38 states and the apparently then existing electoral votes for President possessed by each of these 38 states.

U.S. Pat. No. 4,140,319 to Kenneth W. Aycock et al is directed to a money and land acquisition game with six playing pegs; two dice; a playing board; four playing pieces, play (auction) money; transparent tiles; title and deed cards; and venture (situation) cards, issuing commands or instructing the player to move to various places on the board, or pay or collect various amount of money to or from various other player(s).

U.S. Pat. No. 1,153,802 issued to D. D. Lowery is directed to a political game apparatus having a playing board at the center of which is located a dial to be spun by each player under given situations and, radiating outwardly therefore, are a series of segmentally shaped sections constituting spaces containing information regarding the various states, such as, the capital of the state, when the state initially entered the union, viz., United States of America, and the number of electoral votes possessed by each state apparently at the time the application was submitted to the U.S. Patent Office. Territorial possessions of the U.S. are similarly included in the segmented radially arranged spaces.

U.S. Pat. No. 3,525,526 issued to M. A. Kenrick relates to a political board game apparatus for simulating a United States Presidential election. This board game is played with fifty-one (51) political party markers for each player, e.g., elephants or donkeys, pegs, a ring-shaped article, money pieces, voting pieces representing the electoral votes of each subdivision, a discard box and a deck of cards containing at least one card for each state and the District of Columbia, plus blank cards. The playing board is divided into a group of five rows and ten columns to form a playing area having fifty squares. Each square corresponds to a respective state of the United States, with one square being divided into two parts to designate the District of Columbia. Each square has printed or inscribed in it the number of the state to which it corresponds, together with the number of electoral votes assigned to that state. Two cube-shaped dice are utilized, with one having the numbers 0, 1, 2, 4, 7 and 8, whereas the other has the numbers 0, 1, 3, 5, 6 and 9.

It will be readily apparent that none of these games combine the features and teaching aspects of the political game of this invention.

BRIEF DESCRIPTION OF THE DRAWINGS

FIG. 7A is a top plan view representing the question and answer-containing side of 16 of the 50 debate cards, some of which are given to each player at the beginning of the game with the remainder being placed in the space indicated in the central area of the game board.

FIG. 7B is a top plan view representing the question and answer-containing side of another 16 of the debate cards.

FIG. 7C is a top plan view of the question and answer-containing side of yet another 16 of the debate cards.

FIG. 7D is a top plan view representing the question and answer-containing side of the remaining 2 of the 50 debate cards.

FIG. 8 is a top plan view of the outer facing (viewable) portion characterizing each viewable surface of each respective red drawing card as arranged in a stack in the central portion of the game board.

FIG. 9 is a top plan view of the viewable surface of each respective white drawing card as arranged in its stack in the central portion of the game board.

FIG. 10 is a top plan view characterizing each viewable surface of each respective debate card as arranged in its respective stack in the central portion of the game board.

FIG. 11 is a plan view in perspective of the six denominations of paper play currency (money) with which the game is played. The denominations indicated are those in U.S. dollars.

DETAILED DESCRIPTION OF THE INVENTION

Figure 1:
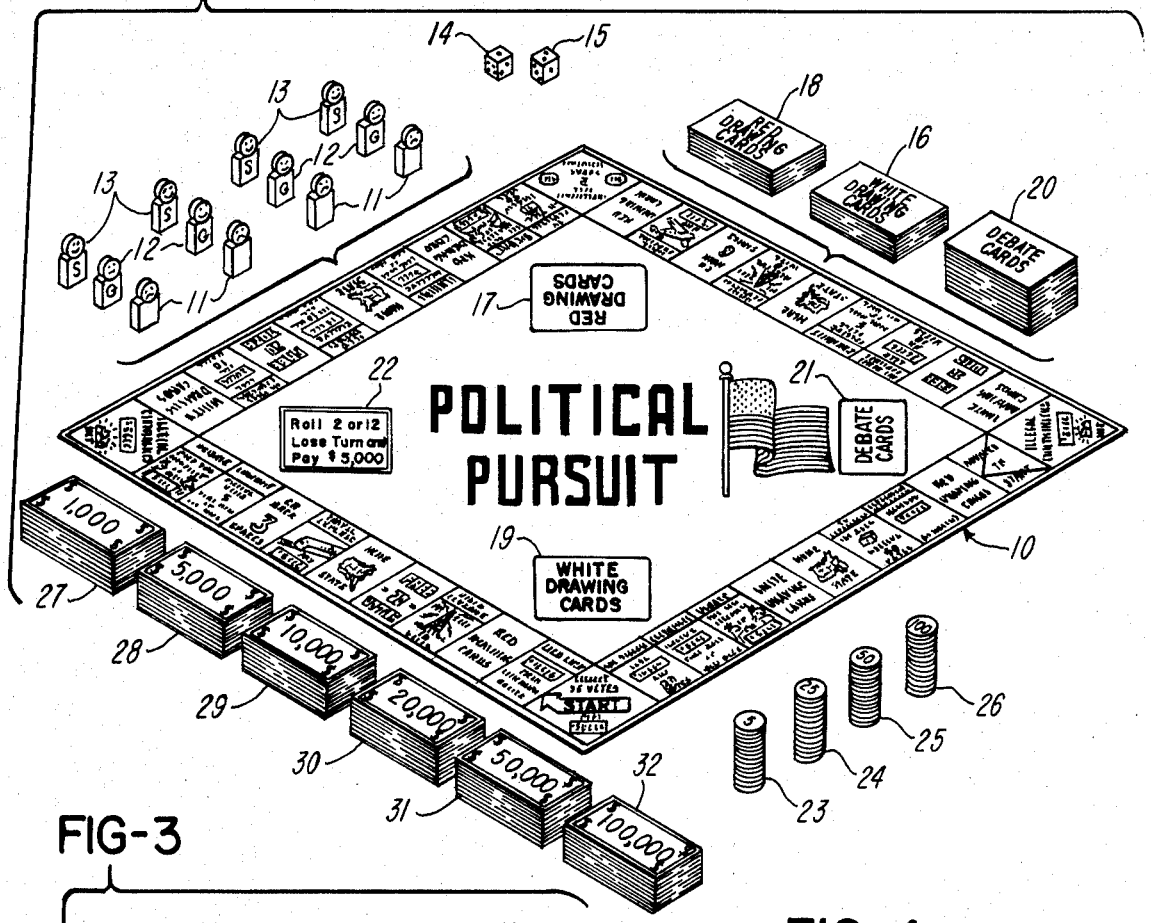
FIG. 1 is a plan view of the entire layout of the game, in perspective, including the playing board (with the lettering of the peripheral spaces being symbolically indicated), the game pieces being shown in the upper left hand portion of FIG. 1, the dice in the upper central portion thereof, the decks (piles) of drawing cards and debate cards being shown in the upper right hand portion thereof, the vote tokens or chips being shown in the lower right portion thereof, and the stacks of various denominations of play money being shown in the left, lower and central portions of FIG. 1.
Figure 3:
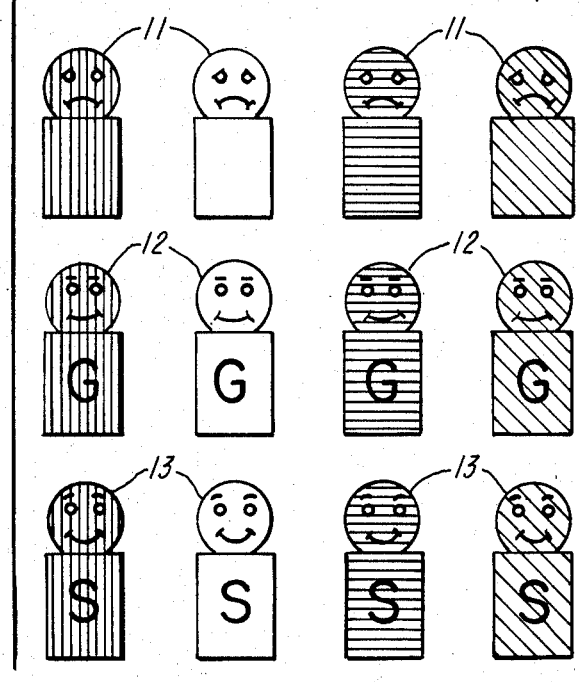
FIG. 3 is a plan view showing the maximum number of playing pieces (12) for the maximum number of players (4) participating in the game in sets of three (3) with each set of playing pieces being represented in distinctive color (according to the drafting rules of the United States Patent and Trademark Office) and depicting different political status differentiated by facial expression and chest lettering or lack thereof.

As will be apparent from FIG. 1, the game may be called POLITICAL PURSUIT which is the title shown at the game board central portion in FIG. 1. The game is played with a maximum of four frowning playing pieces, 11 (for four players) representing the characters at the start of each game. Each character 11 has a facial frown with no lettering on the chest portion and represents a candidate for Governor. Each such candidate can win one of Gubernatorial (Governor) playing pieces 12 which will be utilized to continue the game. This play piece is distinguished from all the rest by having the capital letter G on the chest and a moderate (faint) smile on the face thereof.

Should one attain the higher rank of Senator, this play piece 13 has the capital letter S on the chest and has a broader or wider smile than does playing piece 12.

A pair of conventional dice 14, 15 is used to play the game as indicated previously.

Figure 6:
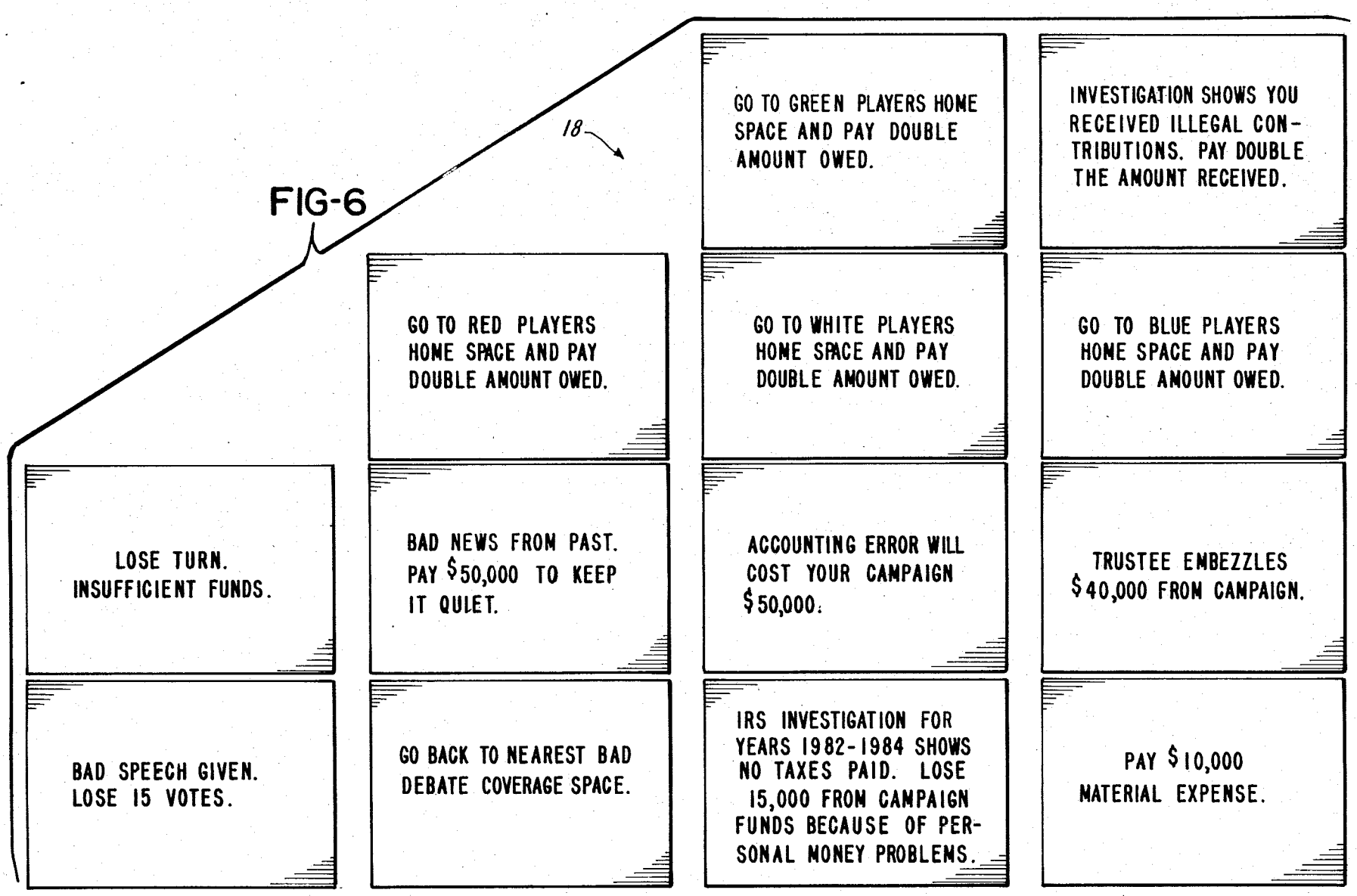
FIG. 6 is a plan view representing the drawing cards of a contrasting color, e.g. red, cards which are placed in the space indicated therefor in the central area of the game board. There are fifteen red cards containing a total of thirteen different instructions, viz., two of the fifteen red cards are duplicates.

The red drawing cards are indicated by reference number 18 (FIGS. 1 and 6) and are placed in the portion 17 as indicated therefore in the playing board.

Figure 5:
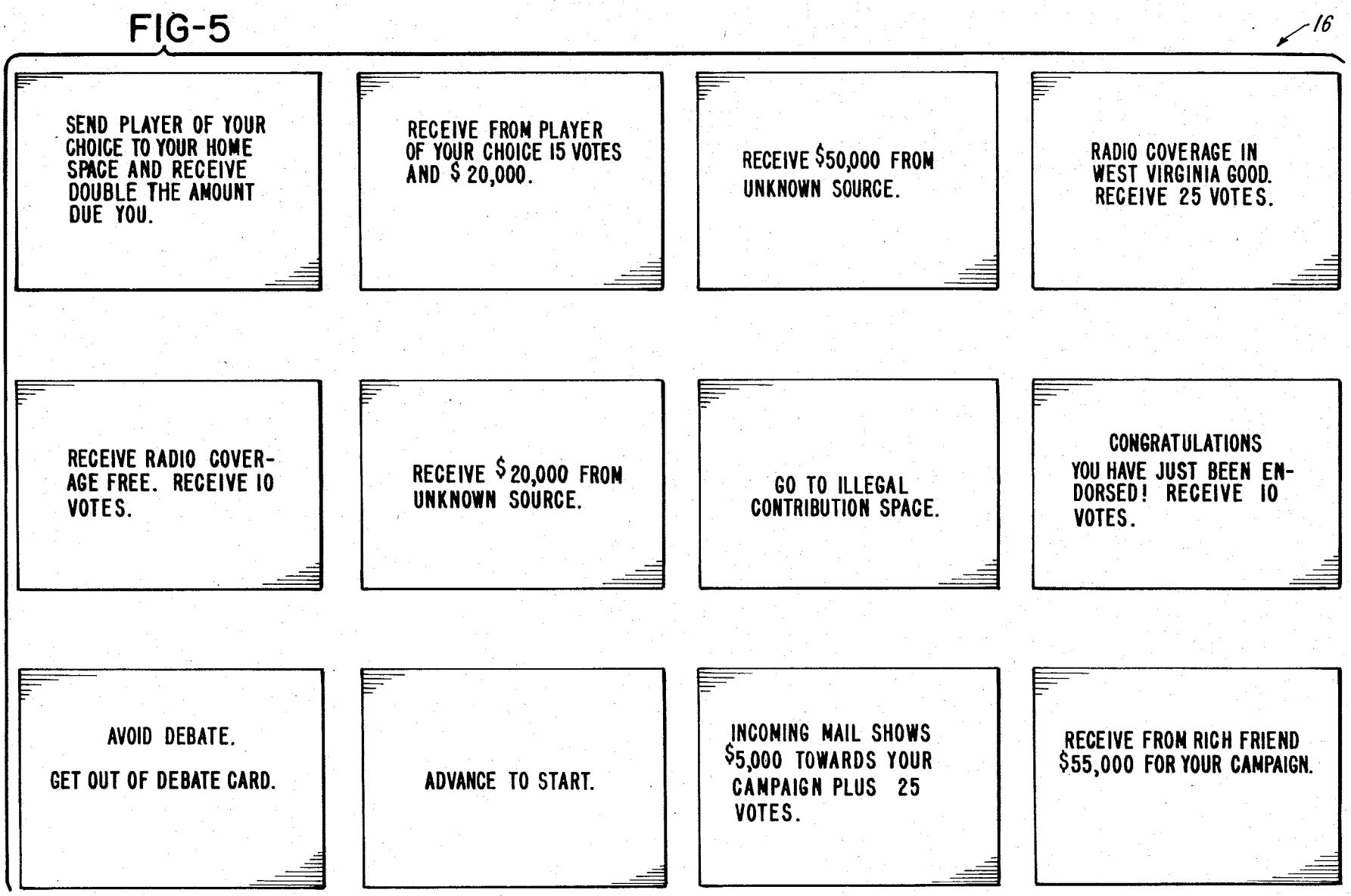
FIG. 5 is a plan view representing drawing cards of one color, e.g. white, cards to be drawn from a stack provided therefor within the central part of the game board. There are fifteen white cards containing a total of twelve different instructions, viz., three of the fifteen white cards are duplicates.

The white drawings cards are referred to by the reference number 16 (FIGS. 1 and 5) and are placed in the corresponding white drawing card 19 on the playing board.

The debate cards are indicated by reference number 20 (FIGS. 7A, 7B, 7C and 7D) and they are placed in the debate card space 21 on the playing board.

The paper play money (currency) as indicated in FIGS. 1 and 11 also bears the respective amounts of dollar value. Play money 27 is in the amount of $1,000 per bill. Play money 28 is in the amount of $5,000 per bill. Play money bills 29 are in the amount of $10,000 per bill. Play money bills 30 count for $20,000 each. Play money bills 31 are for $50,000 each and play money bills 32 count for $100,000 each.

Figure 2A:
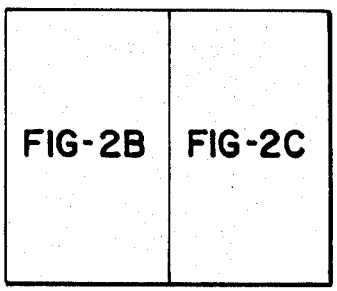
FIG. 2A is a schematic representation of the two halves of the board as represented more fully in FIGS. 2B and 2C.
Figure 2B:
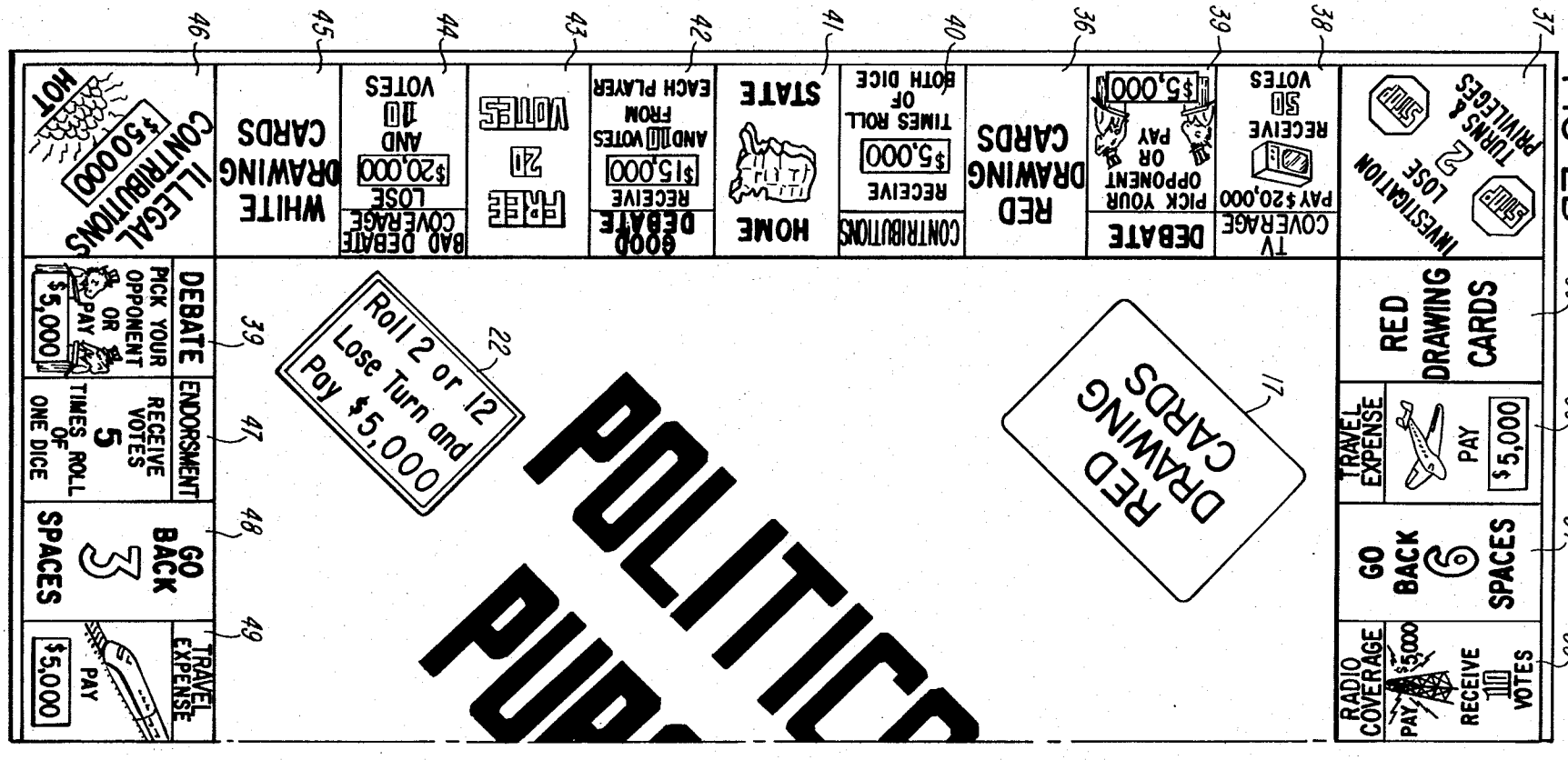
FIG. 2B is a detailed representation of one-half of the game board with the lettering for spaces being indicated thereon and indicating various directions and instructions for playing of the game.
Figure 2C:
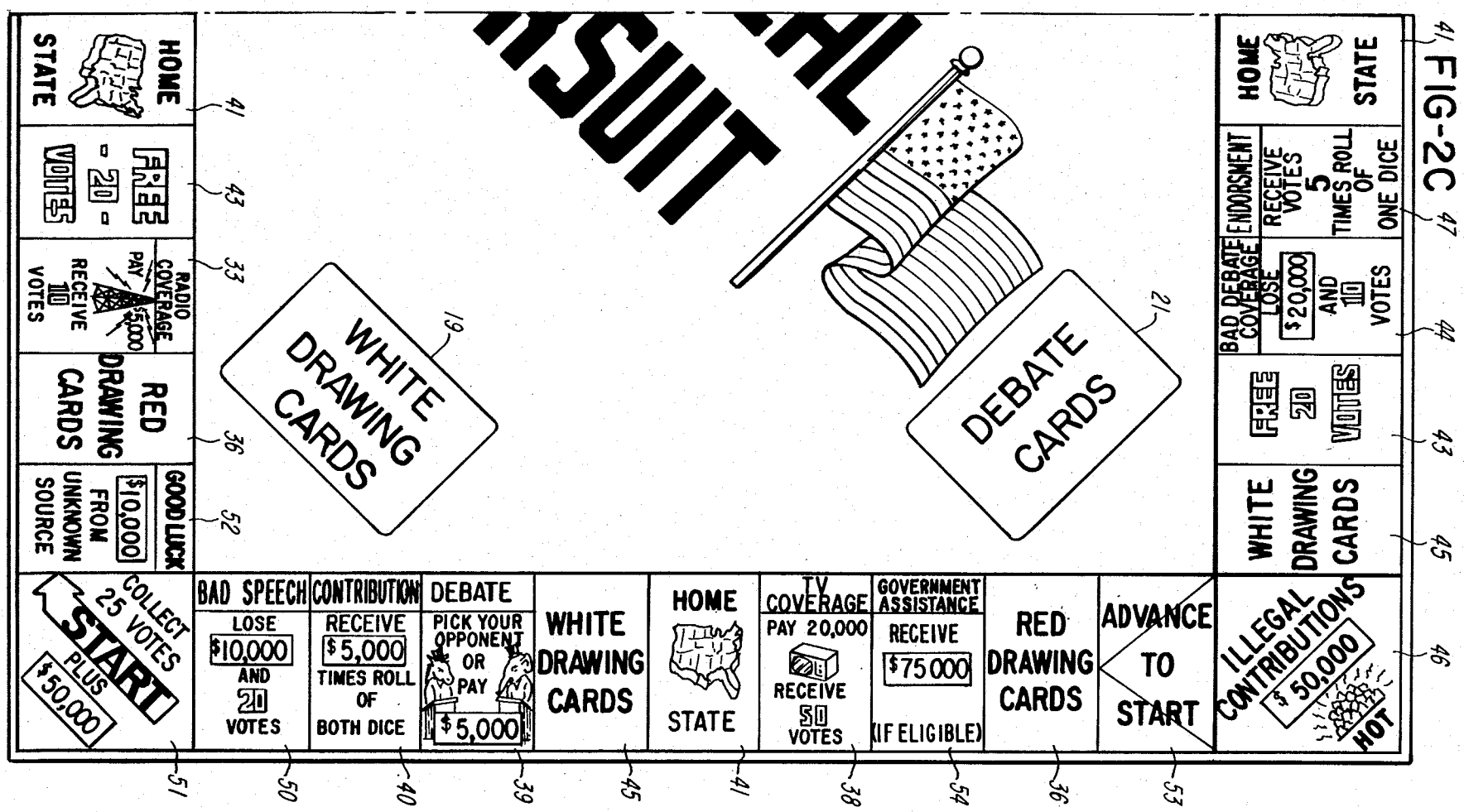
FIG. 2C is a plan view of the other half of the board likewise containing lettering thereon for the remaining spaces in accordance with the directions to be followed by the players landing on each such respective peripheral space.

Next, as will be indicated in detail in FIGS. 2B and 2C and symbolically in FIG. 2A, but not in detail in FIG. 1; a plurality of individual divided spaces 33 through 54 occupy the outer periphery of game board 10, have an important function and exert a very real and essential impact upon the game. Some of these spaces 33 through 54 are repeated on the game board, as will be apparent from the below description and FIGS. 2B and 2C.

The following detailed description of the political board game of this invention will be in terms of the rules and regulations, viz., preparation for play; the objects of the game; how one reaches each respective political office in the political pursuit of winning the game; how the game is won; the rules to be followed during debate and how each player challenges each respective debate opponent player to debate; how a bank loan is arranged; when and how bankruptcy occurs, the consequences thereof to the bankrupt player and others; disqualifying dice rolls, hereinafter referred to as the Rule of 2 and 12; the various characters (playing pieces) and how they are obtained by each player; the handling (distribution and collection) of votes; the use of vote tokens (chips); the board spaces; and the use of respective debate cards, red drawing cards and white drawing cards.

RULES AND REGULATIONS Preparation For Play

Before beginning play, each player will roll both dice with the highest number dice role being elected banker. The banker is responsible for distributing the money at the beginning of the game, handling all money transactions, keeping account of and handling all vote tokens and keeping account of the illegal contributions of each player, as will be more apparent hereinbelow. At the start of the game, each player will receive 25 votes (free) from the banker.

Each player will also receive $150,000 (free) from the banker in the following denominations: one-$50,000 bill, two-$20,000 bills, three-$10,000 bills, four-$5,000 bills and ten-$1,000 bills. Each player will also receive from the banker three debate cards in the event three or four players are playing the game. If two players are playing the game, each will receive five free debate cards from the banker.

Each player in turn will roll both dice with the highest number going first, the next higher number going second, and so on, depending on the number of players. Each player will on his/her turn travel around the board in a clockwise manner or direction the number of spaces as determined by the total of markers thrown on both dice. Each player will then do as indicated by the respective instructions (orders) on the board space on which such player lands.

Objects Of The Game

The main object of the game is to be the first player to become the President of the United States and this is accomplished by being the first player to earn the required combinations of votes and money in sequence of the political pursuit of the Presidency. To become President, a player must have a combination of 300 (electoral) votes and $250,000. However in the event all players except one go bankrupt before any player has accumulated the necessary combination of votes and money to become the President; then the only player left who has not gone bankrupt wins the game.

Reaching Each Political Office

Before a player can become President, that player must first have become a Governor, and then a Senator. Each player in order to proceed through the respective offices of Governor and Senator must gain or attain certain combinations of minimum number of votes and minimum amount of money. To become a Governor, a player must have acquired 150 votes in combination with $150,000. To become a Senator, a player must have acquired a combination of 200 votes and $200,000. To become the President, a player must have acquired a combination of 300 votes (then assuming the most important status of electoral votes) and $250,000.

When a player has enough money and votes to reach one of the offices, he or she must give the other players a warning before making the transaction. By doing this, he or she will give each of the other (opposing) players a chance to debate and perhaps stop the upward move transaction. After such warning is given; this transaction can be made on the upwardly moving player's next turn. If such upwardly moving player forgets or neglects to give the required warning and is caught by an opposing player; the player desiring to move upwardly will be penalized in the same way as if losing a debate, and will pay the amount to the player who caught the player failing to warn.

When each player attains a new or initial political office during the political pursuit of the Presidency, the officeholder must pay back to the bank half of the money which was required to reach that office and surrender to the banker all the votes which were acquired at the time such player reach the initial office of Governor or the new and higher office of Senator. The banker then gives such player a token(s) equal to 25 (free) votes to assist the player in pursuit in the next higher office.

Winning The Game

As noted above, there are only two ways to win the game. The first, and preferable one, is to acquire sufficient votes and money to be acclaimed the President. The only other way to win the game is to be the only player to remain solvent (not to go bankrupt) during each respective game.

Debate Rules And Manner Of Challenging To A Debate

The debate cards that are given to each player at the beginning of the game may be used at any time each respective player takes his turn but before he or she rolls the dice. However, in order to initiate a debate without landing on a debate space, the initiating player will forfeit his/her roll on that turn and must use a debate card from his/her hand. In contrast thereto when upon rolling the dice a player lands on a debate space, 39, the initiating player, the one challenging another of the players to a debate, may use one of his/her debate cards (in his hand) or the top blind debate card (one from the debate card deck 20 located on the game board position 21) on each such debating turn. When the initiating player (challenger) chooses to challenge another player to a debate; the challenged player (challengee), whom the challenging player has chosen to debate, may similarly use either a known debate card from his/her own hand, or pick the top one from the debate card deck 20 (blind debate card) positioned in the appropriate location 21 in the central part of the game board to reverse challenge (counter challenge) the challenger. Care must be exercised in picking up (retrieving) the debate card from the debate card deck lest the opponent see the answer to the debate question.

Since one cannot acquire any free (known) debate cards during the progress of each respective game; use of the debate cards in one's hand and containing a known question and answer by each respective challenging and challenged player should be done wisely. In the course of playing the game and moving clockwise about the game board, if and when a player lands on a debate space 39 on the board, he/she must choose his or her opponent and debate or, in the alternative, pay the bank $5,000 and forfeit the debate.

In conducting the debate, the challenging player (challenger) selects a debate card, be it from the challenger's hand or from the debate deck, and asks the challenged player (challengee) that debate question from the appropriate debate card. This process is then reversed by the challengee.

It should be noted here that the challengee may achieve a tie even if he/she fails to answer the challenger's debate question correctly provided the challenger fails to give the correct answer to the challengee's debate card question selected by the challengee from either his/her own hand or the dec, viz., in the nature of a counter challenge, must answer the same debate question in order to avoid the consequences of losing the debate. Similarly if both players, challengee and challenger, answer his/her respective debate question correctly; a tie is declared. In the event of a tie, a tie breaker must be conducted.

If only one player (challengee or challenger) answers his/her respective debate question correctly, with the other player missing his/her question; the party correctly answering is the winner of the debate. The player who wins a debate receives $20,000 plus 25 votes from the losing party to that debate.

In the event a tie breaker situation occurs, the tie is decided by each respective player rolling one dice. The player who rolls the higher number is declared the winner and receives from the loser $20,000 cash and 25 votes. If both players roll the same number during the initial effort to resolve the tie breaker, each player must roll one dice again and so on until there is a winner of that debate.

It should be evident that each debate involves essential and consequential acquisition and loss of money and votes in relation to knowledge or lack thereof of U.S. political history and trivia.

Bank Loans

At one time, and one time only during each game, each player can borrow $100,000 from the bank. Should he/she lose that money which is borrowed from the bank and have no more money; he/she will be considered to be bankrupt and the game will be ended with respect to each such player. Additionally, it should be observed that a player cannot attain any given political office, viz., Governor, Senator, or President, until his/her loan is repaid to the bank in full.

Bankruptcy

A player becomes bankrupt when he/she owes to any given player or players more money than he/she can pay or have the ability to make a bank loan to satisfy. If the bankrupt player owes his/her debt to the bank, the bankrupt player will pay the bank the entire amount of money that he/she has and surrender all votes to the banker. These votes shall be given to no one except as otherwise permitted in accordance with the game rules. However, if the bankrupt player owes his/her debt to another player, the bankrupt player will surrender whatever money and votes he/she has left at the time of going bankrupt to the player who is owed. In either event, the bankrupt player's game will end and the game will either proceed with the remaining non-bankrupt player(s), or end in favor of a non-bankrupt player.

The Rule of 2 and 12

In the event any player on the roll of both dice during each respective turn during the game rolls a total of 2 or 12, he/she shall lose that turn and pay to the bank a total of $5,000, as indicated by the game board at 22.

Playing Pieces (Characters)

The three playing pieces (characters) of each set are provided in four distinct set colors, preferably green, red, white and blue. When each player begins play in each game, such player will receive one playing piece to represent him/her for the color of each respective HOME STATE SPACE desired. Such color conforms to the color of each respective HOME STATE SPACE 41 located on the peripheral portion of the playing board. The players receive the initial playing piece 11 without any payment, viz., free.

This first playing piece provided to each player is the one representing a beginning candidate character for Governor having a facial frown and a blank chest area (without a letter). The next playing piece each respective player is eligible to receive in the set of three, provided he/she attains the requisite amount of money in combination with the requisite number of votes, is the Governor piece 12. The Governor piece is of the same color as the initial candidate piece, but is distinguished therefrom by the presence of a modest facial smile and a capital G letter located on its chest.

The next piece a player can become eligible to receive is the Senator piece 13, provided, of course, that such player can acquire the required combination of the requisite amount of money and votes therefor. The Senator piece 13 is distinguished from the beginning piece 11 and the Governor piece 12 by having a broader facial smile than the Governor piece and an S on its chest. There is no piece for President because when a player reaches the Presidential level; he/she will be declared winner of the game and that game is then ended.

How to Pay Out Votes

When a player is penalized for votes, yet doesn't have any or doesn't have a sufficient number of votes to pay the penalty, that player is placed in the status of owing that number of votes, viz., is "in the hole" for that number of votes. In the event the votes are owed to another player, that player shall receive $1,000 for each single, individual vote for which the owing player cannot pay at any given stage during the game. Should the player owing the votes acquire the number of votes corresponding to the amount owed to another player, or owed to the bank, the vote-owing player can retrieve the money paid to the opposing player, thereby surrendering the votes, or alternatively, can keep the votes allowing the opposing player or banker to keep the money previously paid in lieu of votes.

Vote Tokens or Chips

Figure 4:
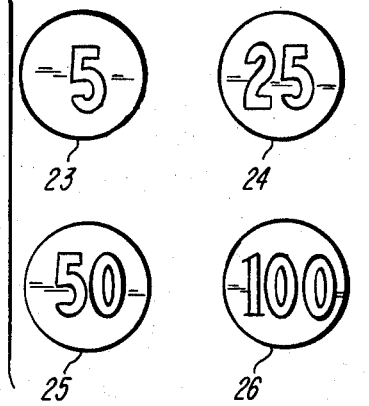
FIG. 4 is a plan view showing the various denominations of vote tokens having their respectively indicated number value of electoral votes.

As will be apparent from FIGS. 1 and 4 of the drawings, the vote tokens or chips are provided in four denominations with four respective different contrasting corresponding colors. The tokens or chips 23 signifying five (5) votes are preferably white; those 24 signifying twenty-five (25) votes are preferably green; those 25 signifying fifty (50) votes are preferably blue; and those signifying one hundred (100) votes 26 are preferably red. The banker is the only person authorized to issue each player vote tokens or chips at the beginning of the game and when they are due during progress of each game. Likewise, the banker is the only authorized person to collect vote tokens or chips when they are lost and required to be paid to the bank during play of the game.

Board Spaces and Consequences Thereof

Starting Space (51):

Each time a player lands on this space (not counting the start of the game), he/she will collect $50,000 and 25 votes from the bank, for his/her campaign. A player will not receive this for going past this space; he or she must land on the space to collect.

Good Luck Space (52):

Each time a player lands on this space, he/she will receive $10,000 stated to be from an unknown source (but actually from the banker). This space is provided as a positive factor to help the players on their campaign trails.

TV (38) and Radio Coverage (33) Spaces:

Each time a player lands on one of these two such spaces; he/she can pay the respective money required, $20,000 and $5,000, and receive the indicated respective numbers of votes, viz., 50 and 10. This money is paid to and votes received from the banker. Alternatively such player can pay $1,000 for landing on the RADIO COVERAGE SPACES as a penalty and receive no votes, or pay $5,000 for landing on the TV COVERAGE SPACES as a penalty and receive no votes. This money is paid to the banker.

Free Vote Spaces (43):

Each time a player lands on one of these three spaces, he or she will collect 20 free votes from the bank.

Candidates Home State Spaces (41): When this space is landed on by any other (opposing) playing piece other than the one who is properly associated with it and entitled to occupy it; he/she must pay the owner 10 votes and $10,000 each time he/she lands thereon. However, each time a player lands on his/her own HOME STATE SPACE, he/she will collect $20,000 and 10 votes from the bank.

When playing the game with a total of two or three players, the same rules apply, viz., a player landing on any HOME STATE SPACE(S) is penalized $10,000, which is paid to the bank. No votes are lost, however, for this.

Travel Expense Spaces (35) and (49):

Each time a player lands on one of these spaces; he/she must pay $5,000 to the bank.

Go Back Spaces (34) and (48):

Each time a player lands on this space; he/she must do as the space directs, viz., go six or three spaces backward respectively.

Endorsement Space (47):

Each time a player lands on one of these two spaces; the player has been endorsed by some organization and will receive a factored number of free votes. The number of votes such player will receive is equal to the number rolled on one dice(die), multiplied by a factor of five (5).

Red (36) and White (45) Drawing Card Spaces:

When a player lands on these spaces, the player will do as the top respective DRAWING CARD directs him/her to do. There are four red drawing card spaces and three white drawing card spaces on the game board.

Illegal Contribution Space (46):

These two spaces offer a player $50,000 each time he/she lands thereon. The landing player can either accept or decline the offer. There is no penalty for declining the offer. If a player accepts the offer, he/she must be aware that there is a risk in so doing. There are two ILLEGAL CONTRIBUTION INVESTIGATION CARDS in the RED DRAWING CARD DECK 18. If a player accepts $50,000 or a multiple thereof, and thereafter picks one of these INVESTIGATION cards; he/she must pay back double the amount ($100,000) for each $50,000 he accepted. These spaces are further characterized on the board by glowing coals above the word "HOT" thus indicating the risk involved.

There are two ways to erase ILLEGAL CONTRIBUTIONS from your records. They are as follows: (1) when a player gets caught and pays double; all prior illegal contributions are erased; (2) after a player reaches each new office, his/her previous ILLEGAL CONTRIBUTIONS are erased and he/she may accept future ILLEGAL CONTRIBUTIONS when and if landing on that space 46, again with the same risk involved.

Bad Debate Space (44):

Whenever a player lands on one of these two spaces; he/she loses $20,000 and 10 votes. This money and votes will be surrendered to the banker for return to the bank.

Advance to Start Space (53):

The lucky player landing on this spaces advances nine (9) spaces to start and collects $50,000 and 25 votes from the bank without encountering any of the possible hazards involved in intervening board spaces 36, 38, 41, 45, 39 or 50 and the Rule of 2 and 12.

Contributions Space (40):

Each time a player lands on one of these two spaces, the player will roll both dice and collect $5,000 times the total number rolled on one roll of both dice.

Government Assistance Space (54):

To be eligible to receive GOVERNMENT ASSISTANCE, a player must have the below tabulated minimum number of votes to enable him/her to advance from one office to the next higher one, when landing on this space, as noted below:

TABLE (1) FROM START TO GOVERNOR, A PLAYER MUST HAVE 75 OR MORE VOTES BEFORE HE OR SHE CAN RECEIVE THE MONEY FROM GOVERNMENT ASSISTANCE (BANK);

(2) FROM GOVERNOR TO SENATOR, A PLAYER MUST HAVE 100 OR MORE VOTES BEFORE HE OR SHE CAN RECEIVE THE MONEY FROM GOVERNMENT ASSISTANCE (BANK):

(3) FROM SENATOR TO PRESIDENT, A PLAYER MUST HAVE 150 OR MORE VOTES BEFORE HE OR SHE CAN RECEIVE THE MONEY FROM GOVERNMENT ASSISTANCE (BANK).

Good Debate Space (42):

A player landing on this space collects $15,000 and 10 votes from each opposing player.

Investigation Space (37):

Each time a player lands on or is directed to go to this space; he/she loses two turns and collection privileges, viz., so long as such player remains in this space; he/she cannot collect either money or votes should an opposing player land on his/her HOME STATE SPACE.

Debate Spaces (39):

Direct the party landing thereon to either pick a debate opponent or pay (to the banker) the sum of $5,000. There are three such debate spaces on the game board.

Bad Speech Space (50):

States that the player landing on it has made a Bad Speech and must lose $10,000 and 20 votes, both of which are paid to the banker for placement in the bank.

Debate, Red and White Drawing Cards

After each card is used, it must be placed on the bottom of its own respective deck with the direction (order) or question and answer containing face upwardly. When all such cards are used; they must be shuffled and placed face downwardly in respective piles (decks) 20, 18, 16.

Debate Questions

What is the minimum age qualification of a U.S. President? Answer—35 years old

What man lost the 1984 Election bid for U.S. President? Answer—Walter Mondale

What department enforces or executes the laws or statutes that the legislature has enacted? Answer—The Executive Department The constitution established the _____ of the United States as the highest judicial power? Answer—Supreme Court Who became the youngest man to take the oath of office as President? Answer—Theodore Roosevelt Who was the first major Black Presidential candidate? Answer—Jesse Jackson The Vice President has no executive authority. True or False? Answer—True Who was the youngest man to be elected U.S. President? Answer—John F. Kennedy How often is a U.S. President elected? Answer—Every Four Years A new U.S. President wins the election, by winning as little as 270 electoral votes. True or False? Answer—True What is the minimum age qualification of a U.S. Senator? Answer—30 Years Old The cabinet members are confirmed by whom? Answer—The U.S. Senate Who is the presiding officer in the U.S. Senate? Answer—The Vice President Who has the sole power of starting the procedure of impeaching government officials for misconduct? Answer—The U.S. House of Representatives A U.S. Representative must be a United States citizen for at least 9 years. True or False? Answer—False The Congress of the United States is made up of what two component powers? Answer—U.S. Senate and U.S. House of Representatives What is the minimum age qualification of a U.S. Representative? Answer—25 Years Old The presiding officer in the U.S. House of Representatives is the speaker. True or False? Answer—True Each State has how many U.S. Senators? Answer—Two How long is the elected term of office of each U.S. Congressman? Answer—Two Years There are three departments of the United States Government. Name two. Answer—1. Legislative Department, 2. Executive Department, 3. Judicial Department What department in the United States government makes the laws? Answer—The Legislative Department.

What is the lower U.S. House of Congress called? Answer—The U.S. House of Representatives There are seven main sections of the constitution. What are these sections called? Answer—Articles To whom does the constitution give the executive power of the government? Answer—The U.S. President To be eligible for election to the U.S. Senate, a person must be a U.S. citizen for at least how many years? Answer—9 Years What officer in the U.S. House of Representatives receives the highest pay? Answer—The Speaker The U.S. Senate has how many powers that are denied to the U.S. House of Representatives? Answer—Three A U.S. Senator must live in the state which he represents. True or False? Answer—True A U.S. Representative must be a citizen of the United States for how many years? Answer—7 Years A U.S. Representative doesn't have to live in the state he represents. True or False? Answer—False What is the name of the district that selects their U.S. Representative? Answer—The U.S. Congressional District How often is a national census done? Answer—Every Ten Years How often does U.S. Congress? Answer—Every Year The U.S. President takes office in what month? Answer—January Who appoints cabinet members? Answer—The U.S. President The Supreme Court consists of what? Answer—Chief Justice and 8 Associate Justices When the U.S. President is impeached, the Speaker of the U.S. House of Representatives takes over. True or False? Answer—False The Vice President is chosen by the U.S. President after he takes office. True or False? Answer—False What is a coalition of voters adhering to common principles and seeking to control the U.S. Government? Answer—Political Party Name one of the last two states admitted to the United States? Answer—Alaska or Hawaii No nominating methods were necessary in the first three U.S. Presidential elections. True or False? Answer—True The U.S. Congress elected in 1980 was the Ninety-Seventh U.S. Congress. True or False? Answer—True Responsibility for the administration and enforcement of immigration laws rests primarily with the U.S. Secretary of State and the Attorney General. True or False? Answer—True How many U.S. Executive Departments were there in 1979? Answer—Thirteen

AFL and CIO were joined together in 1955. True or False? Answer—True

What two major political parties are there in the United States? Answer—U.S. Democrats and U.S. Republicans What U.S. President resigned from office following the Watergate Affair? Answer—Richard Nixon What was the last year immigrants were detained at ports of entry because of technical questions relating to admissibility? Answer—1954

As of 1979 the Federal Government of the U.S. owns around $\frac{1}{3}$ of the total land area of the 50 states. True or False? Answer—True White Drawing Cards Send player of your choice to your home space and receive double the amount due you (for such player landing there). Two of these white drawing cards are provided in the deck located on space 19.

Receive from player of your choice 15 votes and $20,000. Two of these white drawing cards are provided in the deck.

Receive $50,000 from unknown source (the banker).

Radio coverage in West Virginia good. Receive 25 votes (from the banker).

Receive radio coverage free. Receive 10 votes (from the banker).

Receive $20,000 from unknown source (the banker).

Go to illegal contribution space.

Congratulations! You have just been endorsed! Receive ten votes (from the banker). There are two of these cards in the white drawing cards deck.

Avoid debate. Get out of debate card.

Advance to start.

Incoming mail shows $5,000 towards your campaign plus 25 votes (from the banker).

Receive from rich friend $55,000 for your campaign (from the banker).

As will be observed from the foregoing, the total number of white drawing cards is 15.

Red Drawing Cards

Pay $10,000 material (campaign) expense. There are two of these red drawing cards in the deck.

Investigation shows you received illegal (political) contributions. Pay double the amount received. There are two of these red drawing cards in the deck.

Go to red player's home space and pay double amount owed.

Go to white player's home space and pay double amount owed.

Go to blue player's home space and pay double amount owed.

Go to green player's home space and pay double amount owed.

Lose turn. Insufficient funds.

Bad news from past. Pay $50,000 to keep it quiet.

Accounting error will cost your campaign $50,000.

Trustee embezzles $40,000 from campaign. (Pay this amount to the banker.)

Bad speech given. Lose 15 votes. (Give 15 votes to the banker.)

Go back to nearest bad debate coverage space.

IRS (Internal Revenue Service) investigation for years 1982–1984 shows no taxes paid. Lose $15,000 from campaign funds because of personal money problems. (Pay $15,000 to the banker.)

The total of red drawing cards in the deck is 15.

We claim:

1. A political game comprising a square or rectangular game board which includes, along the other periphery thereof, a plurality of divided spaces or sections, each of which has an unfavorable, favorable, or neutral situation or direction for a player whose playing piece lands thereon; a set of different playing pieces for each player, each playing piece within the set for each player being of the same color; a plurality of drawing cards of a first color, each of which either assists or hinders each respective player's pursuit of higher political office potentially culminating in the Presidency of the United States of America; a plurality of drawing cards of a contrasting color containing only cards which hinder a player's pursuit of higher political office; a plurality of debate cards which challenge the debating players' knowledge of American political history including detailed and obscure knowledge; paper play money of a plurality of different denominations and worth; a pair of dice of generally cubical shape and containing size substantially flat surfaces, each surface containing a different number of dots ranging from one to six; a plurality of vote tokens, having a corresponding plurality of different denominations and worth different number of votes and a set of rules and regulations governing play whereby to win, a player either progresses from candidate to governor to senator to president by sequentially acquiring a combination of money and votes for each office, or is the only player to remain financially solvent whereas all opposing players have gone bankrupt.

2. A political game as in claim 1 including a plurality of different sets of debate cards, each set containing questions of a given level of difficulty enabling said game to be played at different levels of age, schooling and educational development.

3. A political game as in claim 1 wherein each set of playing pieces includes a potential plurality thereof up to a maximum of three for each player and each playing piece is readily distinguishable from others in each set by its facial expression.

4. A political game as in claim 1 wherein two of the playing pieces in each set have chest indicia or marking indicating player status and political position.

5. A political game as in claim 1 wherein each playing piece in each set has a face and chest with its different, respective facial expression and chest marking, or lack thereof.

* * * * *